US007980306B2

(12) United States Patent
Lovell et al.

(10) Patent No.: US 7,980,306 B2
(45) Date of Patent: Jul. 19, 2011

(54) METHODS, SYSTEMS AND APPARATUS FOR COILED TUBING TESTING

(75) Inventors: John R. Lovell, Houston, TX (US); Warren Zemlak, Moscow (RU); Marc Allcorn, Sugar Land, TX (US); Luis F. Peixoto, Houston, TX (US); Steven Harrison, Sugar Land, TX (US); Andrew Prestridge, Essex (GB); Gokturk Tunc, Houston, TX (US); Frank Espinosa, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 269 days.

(21) Appl. No.: 11/461,898

(22) Filed: Aug. 2, 2006

(65) Prior Publication Data

US 2007/0044960 A1 Mar. 1, 2007

Related U.S. Application Data

(60) Provisional application No. 60/713,570, filed on Sep. 1, 2005.

(51) Int. Cl.
*E21B 47/01* (2006.01)
*E21B 43/12* (2006.01)

(52) U.S. Cl. ..... 166/250.17; 166/250.01; 166/250.02; 166/250.07; 166/369

(58) Field of Classification Search ..... 166/250.17, 166/250.01, 250.02, 250.07, 250.1, 77.2, 166/369

See application file for complete search history.

(56) References Cited

U.S. PATENT DOCUMENTS

| | | | | |
|---|---|---|---|---|
| 3,722,589 | A | | 3/1973 | Smith |
| 4,278,130 | A | | 7/1981 | Evans |
| 4,320,800 | A | | 3/1982 | Upchurch |
| 4,510,797 | A | | 4/1985 | Guidry |
| 4,541,481 | A | | 9/1985 | Lancaster |
| 4,553,428 | A | | 11/1985 | Upchurch |
| 4,898,236 | A | | 2/1990 | Sask |
| 4,984,634 | A | | 1/1991 | Pilla |
| 5,287,741 | A | | 2/1994 | Schultz |
| 5,297,629 | A | | 3/1994 | Barrington |
| 5,353,875 | A | | 10/1994 | Schultz |
| 5,503,014 | A | | 4/1996 | Griffith |
| 5,573,225 | A | | 11/1996 | Boyle |
| 5,638,904 | A | | 6/1997 | Misselbrook |
| 5,699,996 | A | | 12/1997 | Boyle |
| 5,799,733 | A | * | 9/1998 | Ringgenberg et al. ..... 166/264 |
| 5,819,853 | A | | 10/1998 | Patel |
| 5,826,654 | A | | 10/1998 | Adnan |
| 5,828,003 | A | | 10/1998 | Thomeer |

(Continued)

FOREIGN PATENT DOCUMENTS

| | | |
|---|---|---|
| EP | 0697501 | 2/1996 |

(Continued)

*Primary Examiner* — Giovanna C Wright
*Assistant Examiner* — Brad Harcourt
(74) *Attorney, Agent, or Firm* — Michael Flynn; Dave Hofman; Robin Nava

(57) ABSTRACT

A method and apparatus for testing a multi-zone reservoir while reservoir fluids are flowing from within the wellbore. The method and apparatus enables isolation and testing of individual zones without the need to pull production tubing. This abstract allows a searcher or other reader to quickly ascertain the subject matter of the disclosure. It may not be used to interpret or limit the scope or meaning of the claims.

13 Claims, 8 Drawing Sheets

U.S. PATENT DOCUMENTS

| | | | | |
|---|---|---|---|---|
| 5,884,701 | A | 3/1999 | Von Plahn | |
| 5,933,945 | A | 8/1999 | Thomeer | |
| 6,065,540 | A | 5/2000 | Thomeer | |
| 6,328,103 | B1 * | 12/2001 | Pahmiyer et al. | 166/250.17 |
| 6,889,771 | B1 | 5/2005 | Leising | |
| 2005/0061517 | A1 * | 3/2005 | Wittrisch | 166/369 |
| 2005/0263281 | A1 | 12/2005 | Lovell | |
| 2006/0096753 | A1 | 5/2006 | Zheng | |

FOREIGN PATENT DOCUMENTS

| | | |
|---|---|---|
| WO | 2004007898 | 1/2004 |
| WO | 2004099565 | 11/2004 |

* cited by examiner

METHODS, SYSTEMS AND APPARATUS FOR COILED TUBING TESTING

CROSS-REFERENCE TO RELATED APPLICATIONS

The present application claims priority under 35 U.S.C. §119(e) to U.S. Provisional Application Ser. No. 60/713,570, filed Sep. 1, 2005, incorporated by reference herein in its entirety.

BACKGROUND OF THE INVENTION

1. Field of Invention

The present invention relates generally to the field of testing hydrocarbon-bearing formations, and more particularly to methods, systems and apparatus useful in such operations.

2. Related Art

Coiled tubing is a technology that has been expanding its range of application since its introduction to the oil industry in the 1960's. Its ability to pass through completion tubulars and the wide array of tools and technologies that can be used in conjunction with it make it a very versatile technology, and this versatility is the core of this invention. Recent advances in coiled tubing allow real-time control of downhole equipment, transmission of measurement data and isolation of individual zones within the reservoir.

Typical coiled tubing apparatus includes surface pumping facilities, a coiled tubing string mounted on a reel, a method to convey the coiled tubing into and out of the wellbore, and surface control apparatus at the wellhead. During the spooling process the coiled tubing is plastically deformed as it comes off the reel and is straightened by the injector as it is run into the well. The coiled tubing will expand slightly under the influence of differential pressure.

One typical method of testing and evaluating reservoirs is drill-stem testing. Another is wireline testing. Reservoir boundaries, skin and permeability information are needed to optimize production and reservoir development. Problems arise because of commingled flow.

Unfortunately, drill-stem testing requires removing existing completions, and includes the cost of bringing a rig to convey individual sections of drillpipe. Drill-stem testing also does not lend itself to real-time data collection during the testing operation. Wireline testing includes the necessity to kill the well to convey the wireline tool, which is undesirable, and the short interval that can be tested is frequently unsatisfactory.

Multiple patents exist for reservoir testing using concentric coiled tubing. Reservoir fluid is returned up the innermost layer and well-control fluid is pumped in the outermost layer of the concentric tubing. Sophisticated valves and flow apparatus are required at the surface to maintain well control as the reservoir fluid is diverted into the surface production facilities. The weight and cost of the concentric coiled tubing limits commercial application.

There remains a need for methods and apparatus to test and evaluate reservoirs without having to remove existing completion equipment in the wellbore. There is also a need for methods and apparatus to test and evaluate individual zones within a reservoir including testing of those zones that would not normally flow without artificial lift. Methods and apparatus that may provide a stable amount of hydrostatic lift to a reservoir zone are desired, as well as methods and apparatus for reliably conveying formation fluids from the interior of coiled tubing to the annulus around coiled tubing at some point higher in the string. There is also a need for valve apparatus at the base, or anywhere between the surface and the base of a coil of coiled tubing, and there is a need for data communication to the valve apparatus to find out what is going on at or near the valve apparatus.

SUMMARY OF THE INVENTION

An embodiment of the present invention provides a method of testing a multi-zone reservoir while reservoir fluids are flowing from within a wellbore. The method comprises the steps of: running coiled tubing into the wellbore; activating a zonal isolation apparatus to isolate at least one zone; allowing fluid to flow from the isolated zone; and measuring the downhole flow and pressure of the fluid flowing from the isolated zone.

Another embodiment of the present invention provides a method of testing a multi-zone reservoir while reservoir fluids are flowing from within a wellbore. In this embodiment, the method comprises the steps of: running coiled tubing into the wellbore; setting a first isolation apparatus to prevent reservoir fluid from flowing to surface; activating a zonal isolation apparatus below the first isolation apparatus to isolate a first zone; allowing fluid to flow from the first zone; measuring the downhole flow and pressure of the fluid flowing from the first zone; and diverting the fluid flow from the first zone to the annulus above the first isolation apparatus.

Yet another embodiment of the present invention provides an apparatus for testing reservoir fluids while they are flowing from a wellbore. The apparatus comprises: coiled tubing; a straddle system of packers activated to isolate a reservoir zone, the straddle system conveyed and positioned by the coiled tubing; a surface controlled valve system that enables fluid pumped from the surface to flow into the wellbore annulus above the straddle system of packers, enables fluid pumped from the surface to flow into a zone isolated by the straddle system of packers, and enables fluid flowing from the isolated zone of the reservoir to flow into the annulus above the straddle system of packers; and a measurement apparatus to provide flow measurements for fluid flowing from the isolated zone.

The various aspects of the invention and permutations thereof will become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which:

FIG. 6 illustrates schematically in side elevation, partially in cross section, a communication system using a bundle of optical fibers inside a metal tube that has been inserted into spoolable tubing. The optical fibers transmit data but no power. The downhole sensors are powered by a;

FIG. 7 illustrates schematically an apparatus of the invention allowing a spoolable connector to be broken into two and a component inserted therein between;

Figure 1:
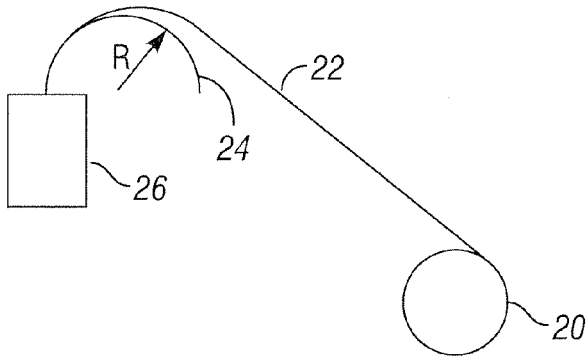
FIG. 1 (Prior Art)
FIG. 1 is a schematic illustration of a prior art coiled tubing apparatus used for well treatment operations.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it may be understood by those skilled in the art that the present invention may be practiced without these details and that numerous variations or modifications from the described embodiments may be possible.

By "wellbore", we mean the innermost tubular of the completion system. "Surface", unless otherwise noted, means very generally out of the wellbore, above or at ground level, and generally at the well site, although other geographic locations above or at ground level may be included. "Tubular" and "tubing" refer to a conduit or any kind of a round hollow apparatus in general, and in the area of oilfield applications to casing, drill pipe, metal tube, or coiled tubing or other such apparatus. By "well servicing", we mean any operation designed to increase hydrocarbon recovery from a reservoir, reduce non-hydrocarbon recovery (when non-hydrocarbons are present), or combinations thereof, involving the step of pumping a fluid into a wellbore. This includes pumping fluid into an injector well and recovering the hydrocarbon from a second wellbore. The fluid pumped may be a composition to increase the production of a hydrocarbon-bearing zone, or it may be a composition pumped into other zones to block their permeability or porosity. Methods of the invention may include pumping fluids to stabilize sections of the wellbore to stop sand production, for example, or pumping a cementations fluid down a wellbore, in which case the fluid being pumped may penetrate into the completion (e.g. down the innermost tubular and then up the exterior of the tubular in the annulus between that tubular and the rock) and provide mechanical integrity to the wellbore. As used here in the phrases "treatment" and "servicing" are thus broader than "stimulation". In many applications, when the rock is largely composed of carbonates, one of the fluids may include an acid and the hydrocarbon increase comes from directly increasing the porosity and permeability of the rock matrix. In other applications, often sandstones, the stages may include proppant or additional materials added to the fluid, so that the pressure of the fluid fractures the rock hydraulically and the proppant is carried behind so as to keep the fractures from resealing. The details are covered in most standard well service texts and are known to those skilled in the well service art so are omitted here.

As used herein, the terms "BOP" and "blow-out preventer" are used generally to include any system of valves at the top of a well that may be closed if an operating crew loses control of formation fluids. The term includes annular blow-out preventers, ram blow-out preventers, shear rams, and well control stacks. By closing this valve or system of valves (usually operated remotely via hydraulic actuators), the crew usually regains control of the well, and procedures may then be initiated to increase the mud density until it is possible to open the BOP and retain pressure control of the formation. A "well control stack" may comprise a set of two or more BOPs used to ensure pressure control of a well. A typical stack might consist of one to six ram-type preventers and, optionally, one or two annular-type preventers. A typical stack configuration has the ram preventers on the bottom and the annular preventers at the top. The configuration of the stack preventers is optimized to provide maximum pressure integrity, safety and flexibility in the event of a well control incident. The well control stack may also include various spools, adapters and piping outlets to permit the circulation of wellbore fluids under pressure in the event of a well control incident.

A "lubricator", sometimes referred to as a lubricator tube or cylinder, provides a method and apparatus whereby oilfield tools of virtually any length may be used in coiled or jointed tubing operations. In some embodiments use of a lubricator allows the coiled tubing injector drive mechanism to be mounted directly on the wellhead. An oilfield tool of any length may be mounted within a closed-end, cylindrical lubricator which is then mounted on the BOP. Upon establishment of fluid communication between the injector and the BOP and wellhead by opening of at least one valve, the oilfield tool is lowered from the lubricator into the wellbore with a portion of the tool remaining within the wellhead adjacent first seal rams located in the BOP which are then closed to engage and seal around the tool. The lubricator may then be removed and the injector head positioned above the BOP and wellhead. The tubing string is extended to engage the captured tool and fluid and/or electrical communication is established between the tubing and the tool. The injector drive mechanism (already holding/attached to the tubing string) may then be connected to the BOP or wellhead and the first seal rams capturing the tool are released and fluid communication is established between the wellbore and the tubing injector drive head. The retrieval and removal of the oilfield tool components are effected by performing the above steps in reverse order.

By "pumping system" we mean a surface apparatus of pumps, which may include an electrical or hydraulic power unit, commonly known as a powerpack. In the case of a multiplicity of pumps, the pumps may be fluidly connected together in series or parallel, and the power conveying the communication line may come from one pump or a multiplicity. The pumping system may also include mixing devices to combine different fluids or blend solids into the fluid, and the invention contemplates using downhole and surface data to change the parameters of the fluid being pumped, as well as controlling on-the-fly mixing.

By the phrase "surface acquisition system" is meant one or more computers at the well site, but also allows for the possibility of a networked series of computers, and a networked series of surface sensors. The computers and sensors may exchange information via a wireless network. Some of the computers do not need to be at the well site but may be communicating via a communication system. In certain embodiments of the present invention the communication line may terminate at the wellhead at a wireless transmitter, and the downhole data may be transmitted wirelessly. The surface acquisition system may have a mechanism to merge the downhole data with the surface data and then display them on a user's console.

In exemplary embodiments of the invention, advisor software programs may run on the acquisition system that would make recommendations to change the parameters of the operation based upon the downhole data, or upon a combination of the downhole data and the surface data. Such advisor programs may also be run on a remote computer. Indeed, the remote computer may be receiving data from a number of wells simultaneously.

Communication lines useful in the invention may have a length much greater than their diameter, or effective diameter (defined as the average of the largest and smallest dimensions in any cross section). Communication lines may have any cross section including, but not limited to, round, rectangular, triangular, any conical section such as oval, lobed, and the like. The communication line diameter may or may not be uniform over the length of the communication line. The term communication line includes bundles of individual fibers, for example, bundles of optical fibers, bundles of metallic wires, and bundles comprising both metallic wires and optical fibers. Other fibers may be present, such as strength-providing fibers, either in a core or distributed through the cross section, such as polymeric fibers. Aramid fibers are well known for their strength, one aramid fiber-based material being known under the trade designation "Kevlar". In certain embodiments the diameter or effective diameter of the communication line may be 0.125 inch (0.318 cm) or less. In one embodiment, a communication line would include an optical fiber, or a bundle of multiple optical fibers to allow for possible damage to one fiber. Commonly assigned U.S. patent application Ser. No. 11/111,230 entitled "Optical Fiber Equipped Tubing and Methods of Making and Using", filed Apr. 21, 2005, discloses one possible communication line wherein an Inconel tube is constructed by folding it around the optical fiber and then laser-welding the joint to close the tube. The resulting construction is referred to as an optical fiber tube, and is very rugged and may withstand severely abrasive and corrosive fluids, including hydrochloric and hydrofluoric acids. Fiber optic tubes are also available from K-Tube, Inc., of California, USA. An advantage of fiber optic tubes of this nature is that it is straightforward to attach sensors to the bottom of the tube. The sensors may be machined to be substantially the same or smaller diameter than the fiber optic tube, which minimizes the likelihood of the sensor getting ripped off the end of the tube during conveyance. Fiber optic tubes are not inexpensive, however, and thus certain embodiments of the invention comprise retrieving the sensors by reverse spooling so that the tube may be reused. The reverse spooling may be controlled by the surface acquisition system, but also may be a standalone apparatus added after the stimulation process is complete.

In an alternative embodiment, the communication line may comprise a single optical fiber having a fluoropolymer or other engineered polymeric coating, such as a Parylene coating. The advantage of such a system is the cost is low enough to be disposable after each job. One disadvantage is that it needs to be able to survive being conveyed into the well, and survive the subsequent fluid stages, which may include proppant stages. In these embodiments, a long blast tube or joint comprising a very hard material, or a material coated with known surface hardeners such as carbides and nitrides may be used. The communication line would be fed through this blast tube or joint. The length of blast joint may be chosen so that the fluid passing through the distal end of the joint would be laminar. This length may be dozens of feet or meters, so the blast joint may be deployed into the wellbore itself. In embodiments where the communication line is a single fiber, the sensing apparatus may need to be very small. In these embodiments, nano-machined apparatus that may be attached to the end of the fiber without significantly increasing the diameter of the fiber may be used. A small sheath may be added to the lowest end of the fiber and cover the sensing portion so that any changes in outer diameter are very gradual.

Referring now to the figures, FIG. 1 is a schematic block diagram, not to scale, of a prior art system embodiment used to deploy a coiled tubing string into a well. (The same numerals are used throughout the drawing figures for the same components unless otherwise indicated.) Illustrated in FIG. 1 is a coiled tubing 22 being unwound from a coiled tubing reel 20 by an injector 26 through a gooseneck 24, as is known in the art. An apparatus (not illustrated) may be provided in any number of positions that may be useful in taking geometric measurements of the coiled tubing. Coiled tubing 22 is spoolable and can be run in hole (RIH), and pulled out of hole (POOH), of a live well because of well-control apparatus at the surface. Reservoir fluids can return up the annulus between coiled tubing 22 and the wellbore (not illustrated in FIG. 1).

Although coiled tubing is useful for a variety of functions at a well site, primarily for its usefulness in being able to convey fluids into and out of a well, well control can be an issue, especially in so-called reverse flow situations, where production fluids may be allowed to flow up through the tubing toward the surface. Further, coiled tubing is subject to plastic deformation during use and pinhole defects and other defects are not uncommon. Concentric coiled tubing may be used to allow a reservoir fluid to return to the surface but it has significant operational issues, including safely diverting the fluids at the surface from the reel of concentric coil to the production facilities.

Figure 2A:
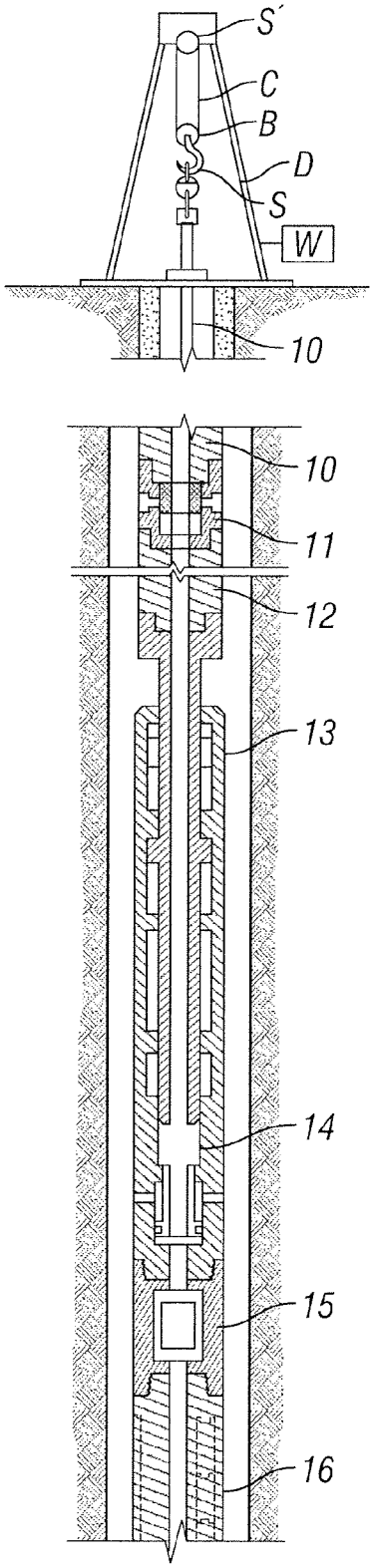
FIG. 2A (Prior Art)
FIG. 2 is a schematic illustration of a prior art drill-stem test apparatus used for well treatment operations.
Figure 2B:
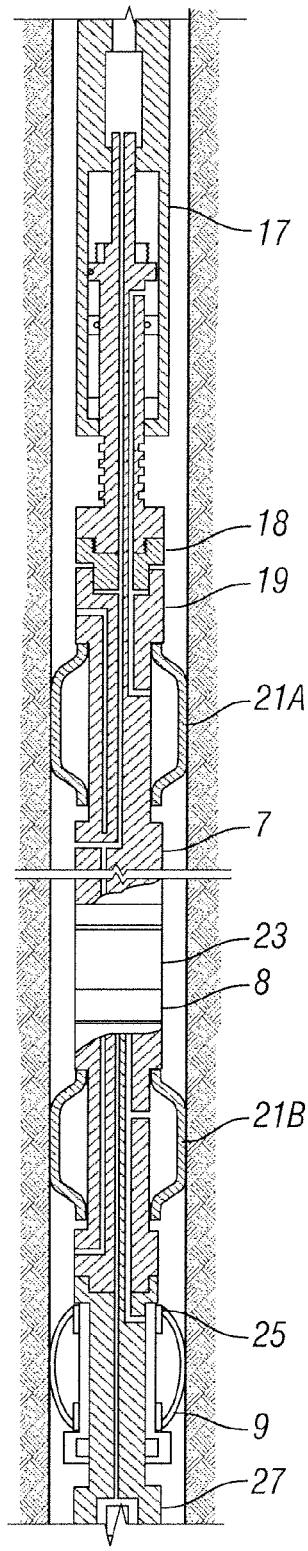
FIG. 2B (Prior Art)

In practice, if reservoir fluids are desired at the surface, they are most typically conveyed through more robust tubing such as used during drill-stem testing. In this case, as illustrated in FIGS. 2A-2B, drill pipe is typically used to convey a system of packers. FIGS. 2A and 2B are substantially the same as FIGS. 1A and 1B from assignee's U.S. Pat. No. 4,320,800. For conducting a test of an interval of the well, the running-in string 10 of drill pipe or tubing is provided with a reverse circulating valve 11 of any typical design, for example a valve of the type illustrated in U.S. Pat. No. 2,863,511, assigned to the assignee of this invention. A suitable length of drill pipe 12 is connected between the reverse circulating valve 11 and a multi-flow evaluator or test valve assembly 13 that functions to alternately flow and shut-in the formation interval to be tested. A preferred form of test valve assembly 13 is illustrated in U.S. Pat. No. 3,308,887, also assigned to the assignee of this invention. The lower end of the test valve 13 is connected to a pressure relief valve 14 that is, in turn, connected to a recorder carrier 15 that houses a pressure recorder of the type shown in the assignee's U.S. Pat. No. 2,816,440. The recorder functions to make a permanent record of fluid pressure versus lapsed time during the test in a typical manner. The recorder carrier 15 is connected to the upper end of a screen sub 16 that serves to take in and to exhaust well fluids during operation of an upper packer inflation pump assembly 17 to which the lower end of the screen sub is connected. The pump assembly 17, which together with the various other component parts of the tool string typically includes inner and outer telescoping members and a system of check valves arranged so that well fluids are displaced under pressure during upward movement of the outer member with respect to the inner member, and are drawn in via the screen sub 16 during downward movement. Thus a series of vertical upward and downward movements of the running-in string 10 is effective to operate the pump assembly 17 and to supply pressurized fluids for inflating the upper packer to be described below.

The lower end of the pump assembly 17 is coupled to an equalizing and packer deflating valve 18 that can be operated upon completion of the test to equalize the pressures in the well interval being tested with the hydrostatic head of the well fluids in the annulus above the tools, and to enable deflating the upper packer element to its normally relaxed condition. Of course an equalizing valve is necessary to enable the packers to be released so that the tool string can be withdrawn from the well. Valve 18 is connected to the upper end of a straddle-type inflatable packer system shown generally at 19, the system including upper and lower inflatable packers 21A and 21B connected together by various components including elongated spacer sub 7. Inflatable packers 21A and 21B each include an elastomeric sleeve that is normally retracted but which can be expanded outwardly by internal fluid pressure into sealing contact with the surrounding well bore wall. The length of spacer sub 7 is selected such that during a test upper packer 21A is above the upper end of the formation zone of interest, and lower packer 21B is below the interval. Of course when the packer elements are expanded as illustrated in FIG. 2A, the well interval between the elements is isolated or sealed off from the rest of the well bore so that fluid recovery from the interval can be conducted through the tools described above and into drill pipe 12.

A rotationally operated pump assembly 23 that is functionally separate from upper pump assembly 17 is connected between the two packers and adapted to supply fluid under pressure to lower packer 21B for inflating the same into sealing engagement with the well bore wall in response to rotation of pipe string 10 extending upwardly to the surface. Pump 23 has its lower end connected to an intermediate packer deflating valve 8 that functions when operated at the end of a test to cause packer 21B to deflate. Lower packer assembly 21B is generally similar in construction to upper assembly 21A, and has its lower end connected to a deflate-drag spring tool 25 having means 9 frictionally engaging the well bore wall in a manner to prevent rotation so as to enable rotary operation of pump assembly 23. Tool 25 may also include a valve that is opened at termination of a test to insure deflation of element 21B.

If desired, another recorder carrier 27 may be connected to the lower end of drag tool 25 and arranged via an appropriate passageway to measure directly the formation fluid pressure in the isolated interval to enable a determination by comparison with the pressure readings of the recorder in upper carrier 15 whether the test passages and ports have become blocked by debris or the like during the test. Also, though not illustrated in FIG. 2, it will be appreciated that other tools such as a jar and a safety joint may be incorporated in the string, for example between test valve assembly 13 and pump assembly 17, in accordance with typical practice.

As shown rather schematically in FIG. 2A, the pipe string 10 typically extends upwardly to the surface where it is suspended for handling within a derrick D by typical structure such as a swivel S, traveling block B and cable C extending between the traveling block and the crown block S' at the top of the derrick. The dead line of the cable has a transducer such as a load cell thereon to sense the weight of the drill string and the tools in 11the borehole. The output of the transducer is coupled to a weight indicator W that provides the rig operator with a visual indication of the precise amount of weight being supported by the cable and the derrick at all times. The line end of the cable extends to a drawworks that is used in typical manner to raise and lower the pipe as desired.

In operation, formation fluid is allowed to flow between packers, then to the surface through the drill pipe and from there to testing and production facilities. The drill pipe cannot be readily moved during this operation from one zone to the next, because an individual joint of pipe cannot be removed from the string without first killing the well. The jointed sections of pipe are also not spoolable so running in and out of the wellbore is time consuming.

Isolation techniques can be conveyed rapidly to the zone of interest when the isolation packers are lowered on a slickline or wireline cable. In this case, no reservoir fluids can be allowed to return to the surface because of the inability to provide well control across the heptacable.

Figure 3:
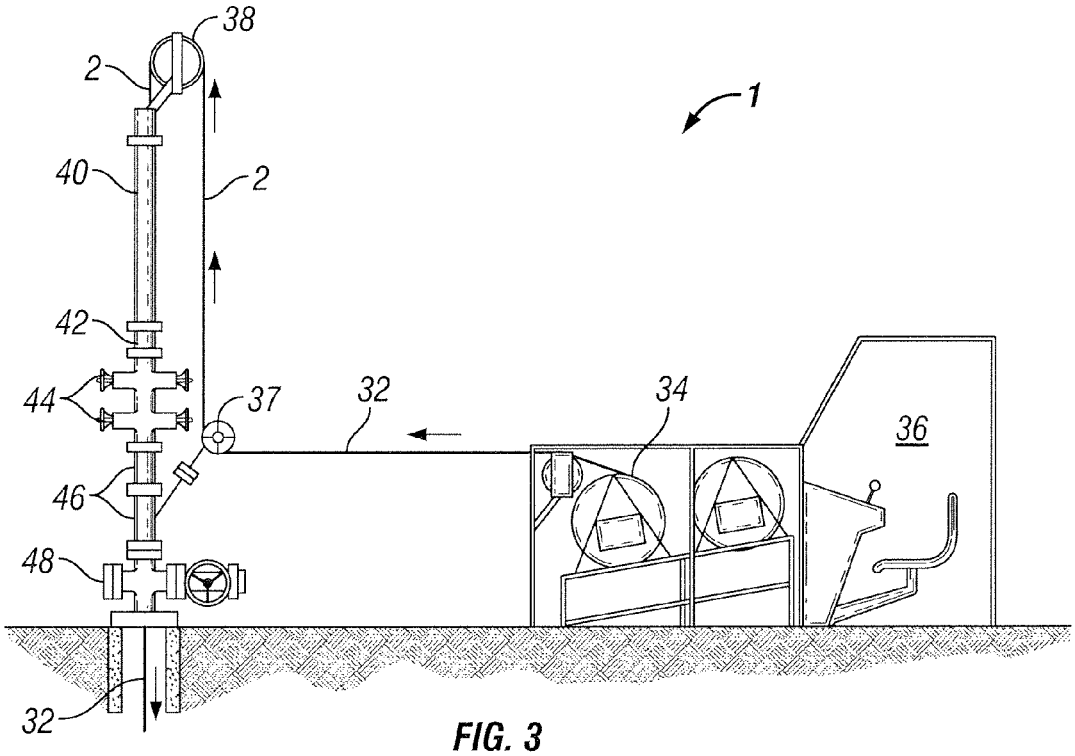
FIG. 3 (Prior Art)
FIG. 3 is a schematic illustration of a prior art wireline testing apparatus used for reservoir evaluation.

FIG. 3 is a schematic illustration of a prior art wireline testing apparatus used for reservoir evaluation. Downhole measurements of flow and pressure are used to derive reservoir properties such as skin, permeability and reservoir extent. Illustrated in FIG. 3, not to scale, is a partial cross-sectional view of a communication slick line or wire line, designated as 32. Communication line 32 is usually kept spooled on a drum 34 kept some distance away from wellhead 48. Typically an operator sits in an operator station 36. Communication line 32 passes over sheaves 37 and 38 prior to passing into the top of a lubricator or stuffing box 40. Lubricator or stuffing box 40 forms the pressure barrier around communication line 32 at its entry point. The remainder of the parts shown complete the well control stack, such as connectors 42 and 46, and BOPs 44.

When there is sufficient bottom-hole pressure, formation fluids flow naturally into the wellbore and upwardly to the surface. Flow characteristics of the reservoir can be simply determined either by gauging at the surface or by lowering a production logging tool into the wellbore. Some difficulty arises, however, when there is insufficient bottom-hole pressure to produce wellbore fluids to the surface. The hydrostatic column of fluid within the wellbore restricts reservoir fluid entry to the formation face or into the wellbore through the perforations. In order to overcome this hydrostatic column and produce fluids from the well, it is well known in the art to provide "artificial lift" of fluids by injecting a gas, usually nitrogen, into the wellbore at a depth sufficient to artificially lift wellbore fluids to the surface.

Figure 4:
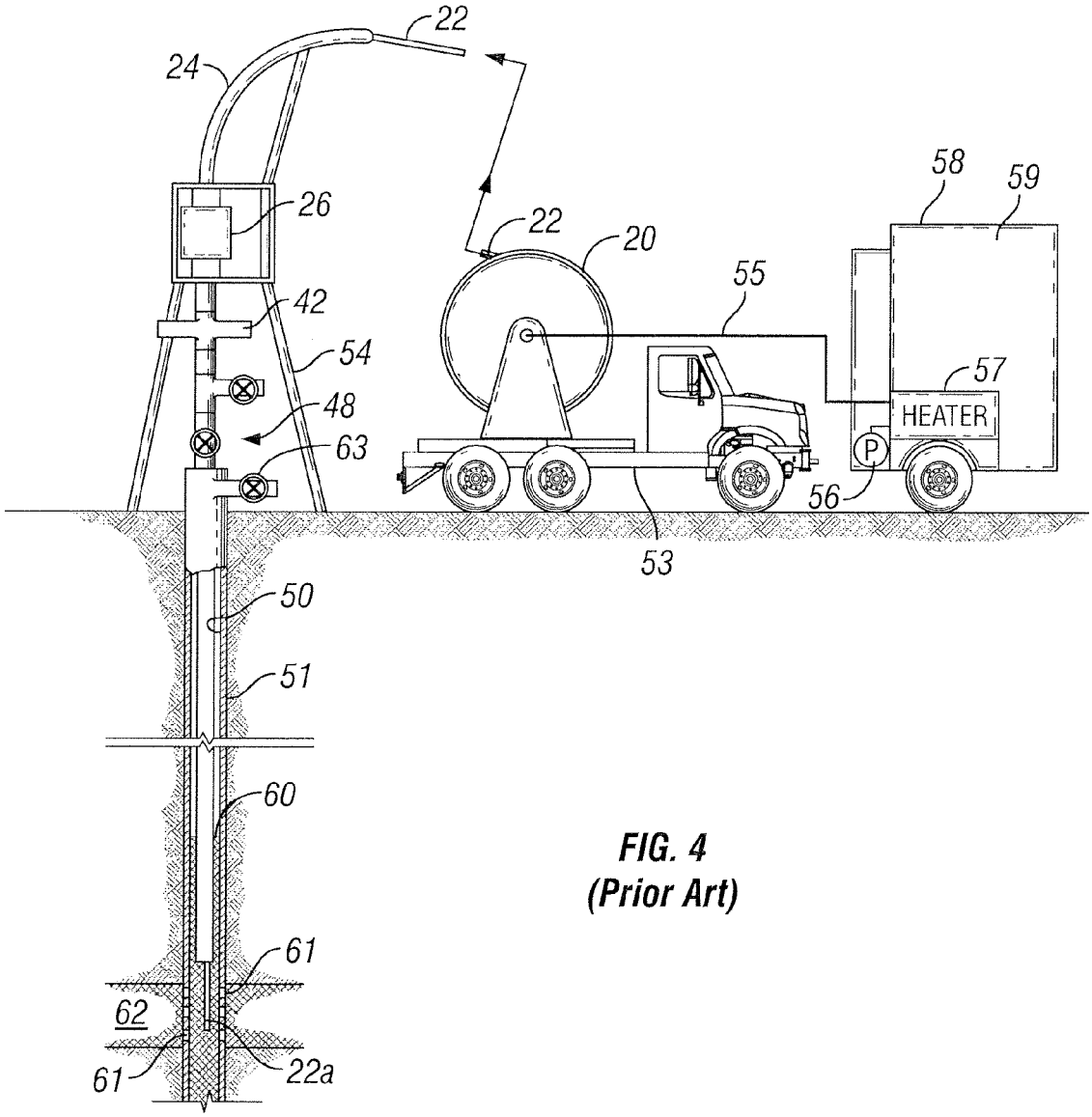
FIG. 4 (Prior Art)
FIG. 4 is a schematic illustration of a prior art production logging operation used for reservoir testing that allows hydrocarbons to return to the surface exterior to spoolable tubing, with or without artificial gas lift.

FIG. 4 illustrates one common way of achieving artificial lift utilizing nitrogen injection, as described in U.S. Pat. No. 3,722,589. The '589 patent describes an apparatus that allows spoolable tubing to be run into the pipe and which allows reservoir fluids to flow to the surface while production measurements are taken. The apparatus may comprise a hydraulic production logging tool in memory mode. The tool measures fluid flow rate and pressure, as well as other parameters such as viscosity, pH, and the like. The production logging tool is lowered to the zone of interest on spoolable tubing. No zonal isolation is possible. Nitrogen or other fluid may be pumped down the coiled tubing to an exit port some distance down the coiled tubing. The gas lifts the reservoir fluids, and the gas exits at some desired point along the tubing.

This technique utilizes coiled tubing which is stored as a continuous length of small diameter pipe on a reel located at the surface. The tubing is injected into the wellbore by well-known coiled tubing operations employing a tubing injector head located at or near the wellhead. Once the remote end of the coiled tubing has reached the proper depth for gas injection, it is a relatively simple matter of pumping the gas through the coiled tubing to produce the desired artificial lift.

Referring to FIG. 4, a well 50 has therein one or more casings 51 lining the wellbore, and may have other pipes, casings, or tubing therein as required, all as well known in the art. Above the wellbore, there is provided a well head 48 which may be of any form employed in the art, the wellhead including devices for suspending pipes in the wellbore, valves, and valve-controlled outlets as is known. Above the wellhead there is typically a BOP 42 or other device through which a pipe string may be run without leakage or pressure from within the well. A tubing injector device 26 is provided, as well as a curved tubing guide 24. Tubing injector device 26 is typically supported by a frame 54, and coiled tubing 22 is typically stored on a reel 20, which may be skid mounted or, as illustrated in FIG. 4, carried on a truck 53 so as to be moveable from job site to job site. Liquid nitrogen may be pumped by a pump 56 through a heater 57 to produce high pressure nitrogen gas which is then delivered through a conduit 55 to coiled tubing 22 by way of hub flow connections of reel 20. Wellbore 10 will in most cases contain a liquid having a level 60 in the well. For displacement of the liquid form the well, the end 22*a* of coiled tubing 22 is injected into the wellbore by injector 26 to a position somewhat below liquid surface 60. As the lower end 22*a* of coiled tubing 22 moves downward in the well, gaseous nitrogen is continuously or discontinuously introduced at a rate so as to purge and circulate incremental portions of the liquid upwardly from the well through the annulus of a well pipe such as casing 51. The liquid is evacuated through an outlet 63 of the well head. After the fluid has been removed from the well, a pressure draw down exists on a reservoir 62 at the lower portion of the well. Casing perforations 61 are provided as known so that fluid communication from reservoir 62 may exist.

Attempts have been made to log the flow within a wellbore in order to determine various reservoir parameters during the production of wellbore fluids by artificial lift utilizing gas injection with coiled tubing. Some difficulties have been noted in interpreting the data received. One patentee noted this was possibly due to the nature of the apparatus used for such logging, theorizing that the logging tool, typically mounted on the coiled tubing immediately below the gas injection orifice, experiences nitrogen bubbles entrained in the wellbore fluid which is passing through the propeller flow meter of the logging tool. Additional theory is that the hydrodynamic effects resulting from the injection of the gas into the wellbore fluid may cause swirls, eddies and the like which may also have an adverse effect on the accuracy of the measurement as determined by the flow meter propeller. Also, due to the size of the pumping equipment commonly employed with coiled tubing, it is necessary to pump relatively large amounts of gas through the apparatus, a condition which may not facilitate the production of the best data in conjunction with a production logging tool attached to the gas injection tool on coiled tubing.

Figure 5:
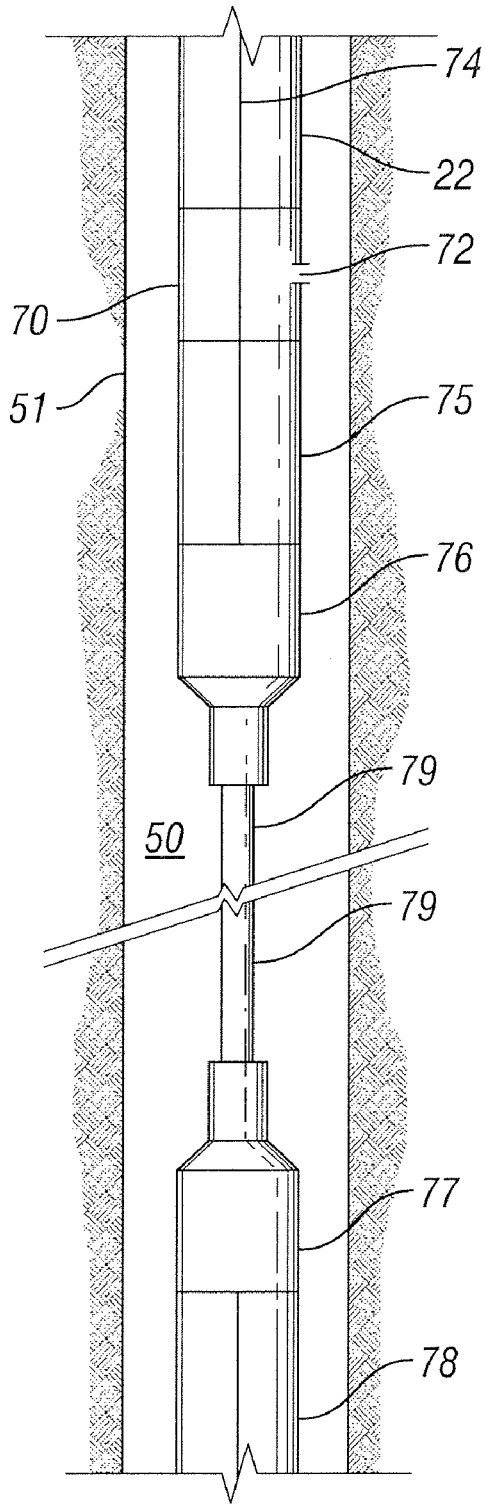
FIG. 5 (Prior Art)
FIG. 5 illustrates schematically a prior art improvement to the apparatus of FIG. 4.

FIG. 5 illustrates schematically a prior art improvement to the apparatus of FIG. 4; as described in U.S. Pat. No. 4,984,634. The '634 patent describes a gas injector tool 70 having at least one gas port 72 located generally on the lower end of a string of coiled tubing 22 within a wellbore 50 having a well casing 51. With the injection of a gas such as nitrogen through coiled tubing 22 and out into wellbore 50 through gas port 72, fluids within wellbore 50 will be artificially lifted to flow upwardly within the wellbore as is well known in the art. In accordance with the '634 patent, gas injection tool 70 has connected to its lowermost end an adaptor member 75 which acts to interconnect gas injection tool 70 with a first wireline cable head connector 76. A wireline 74, allowing electrical communication from the surface to the cable head, passes through coiled tubing 22, gas injector tool 70, adaptor 75 and is connected to the electrical connectors within the first cable head 76. Below first cable head 76, a support spacer 79 extends downwardly to a second cable head connector 77 and establishes electrical communication between first cable head 76 and second cable head 77. Second cable head 77 is then connected to a production logging tool 78 in accordance with standard wireline logging connection procedures. Production logging tool 78 can then log the flow rate of fluids upwardly within wellbore 50. As stated previously, the length of the spacer member 26 may be adjusted to a length which will accomplish the desired ends of both removing the production logging tool from the effects of gas injection and allow for the adjustment of the flow rate of wellbore fluids within wellbore 50 relative to an available flow rate of gas through the coiled tubing and out port 72 of gas injection tool 70. Generally, the length of the spacer member 79 is varied between about 100 feet to in excess of 1000 feet (about 30 to 300 m).

FIG. 6 illustrates schematically in side elevation, partially in cross section, a communication system using a bundle of optical fibers inside a metal tube that has been inserted into spoolable tubing. The optical fibers transmit data but no power. The downhole sensors are powered by a;Illustrated is a coiled tubing 22 having an optical fiber carrier conduit or tube 86, which may be straight as illustrated. Tube 86 routes one or more optical fibers 92 through coiled tubing 22. Optical fiber termination end 89 is illustrated having four optical fiber terminations, while a second end includes a cartridge seal 93, and a mechanical hold and seal 87, which in this embodiment is a compression style fitting. This series of seals 87, 93, and a bulkhead seal (not illustrated) sealingly connects body 88 to optical fiber carrier 86. Optical fiber 92 may have slack, which may be wound around a fiber optic termination support rod 94 for a portion of its length. A bare fiber optic bulkhead 96 is provided which functions to seal off fiber carrier 86 from well bore and treatment fluids in the event that the coiled tubing head or bottom hole assembly has a failure. A series of connectors 80A, 80B and 82 may be employed as illustrated. Connector 80B may be a threaded collar. Note that a fluid flow path is provided through coiled tubing 22, connectors 80A, 80B, and 82, and through coiled tubing head 82 at 98. Item 85 is a protector and could be replaced with a variety of components.

Figure 6A:
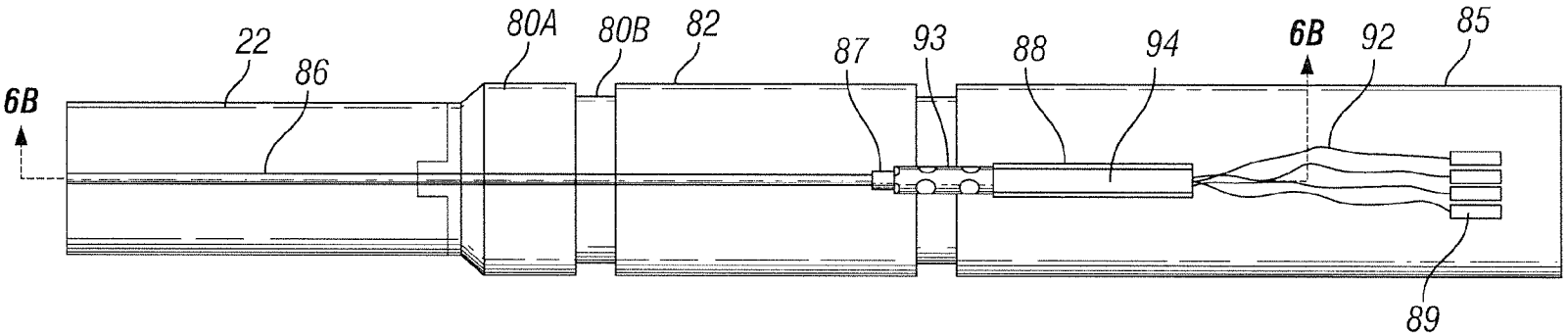
Figure 6B:
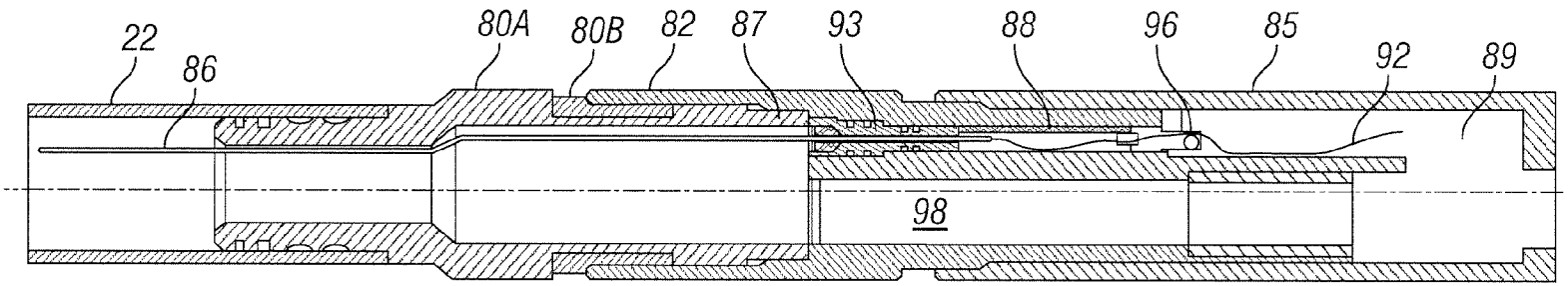

The communication system may be an electrical cable or a system of optical fibers inside a metal tube such as illustrated in FIGS. 6A and 6B just described. An advantage of using a tube containing optical fibers is that the tube takes up less space inside the coiled tubing and causes less drag. In particular, the tube can be inserted into the coiled tubing before the operation. In the case when the communication system includes an optical fiber, the pressure sensor may also be an optical pressure sensor. A light source such as a laser is included on the coiled tubing reel, which activates the pressure sensor.

It is a feature of this invention to extend the communications system past the point where the nitrogen exits down to the production logging tool. In this case, the reservoir flow and pressure measurements are available in real-time, which greatly enhances the value to the customer. In one embodiment, the apparatus for this requires a lower communication system from the production logging tool to the nitrogen exit, wherein a communications bulkhead may be provided to pass data from directly below the nitrogen valve to directly above it. The upper communication system then conveys the data from there to the surface.

Figure 7:
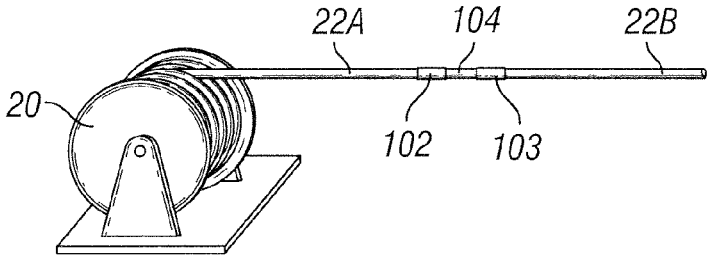

It is also a feature in this invention to provide means for deploying the production logging system without having to kill the well before and after the operation. As illustrated in FIG. 5 there is an exit point 72 in the coiled tubing through which the nitrogen is pumped; this means that there could be well control problems. What is needed is a way to insert a check-valve above the hole 72, so that nitrogen could be pumped down the coiled tubing but reservoir fluids could not enter. The embodiment illustrated in FIG. 7 presents a solution to this problem. Illustrated is a coiled tubing reel 20 having an upper portion of coiled tubing 22A spooled thereon. An upper spoolable connector 102 connects coiled tubing 22A with a non- spoolable check valve 104, which is in turn connected to a bottom spoolable connector 103, and finally to a lower portion 22B of coiled tubing. The latter is closed by the production logging tool (not illustrated), and is run in hole until spoolable connector 103 is at the level of the well-head. Neutral kill-fluid such as brine or water is pumped into the coiled tubing to fill it to that point. The rams are closed around the coiled tubing and the spoolable connector is then separated into two. Note that two barriers for well control exist: the coiled tubing itself plus the kill-fluid. A new device, such as a check valve apparatus 104 may then be added to lower portion 22B of coiled tubing. The new device may have an exit port for nitrogen and a double-flapper check-valve above it. The upper spoolable connector 102 is then attached to the newly installed device. The assembly can now be safely run into the wellbore.

FIG. 7 illustrates schematically an apparatus of the invention allowing a spoolable connector to be broken into two and a component inserted therein between; While the type of connection is not illustrated, threaded connections, turnbuckle connections, or other similarly functioning connection type may be used. One advantage is to provide for the introduction of a check-valve or other component by having a system that can be shipped to the rig as two coils spooled together. They are unspooled at the rig and a valving apparatus is inserted which allows the system to be deployed under pressure.

Another feature of the invention is to extend this method and apparatus to allow a lower communication system to be attached to an upper communication system during this process, as well as attaching a pressure sensor.

The coiled tubing apparatus and systems described so far do not include the zonal isolation of prior art systems illustrated for example in FIG. 2 (drill-stem testing) and FIG. 3 (wire-line testing). When there are multiple flowing intervals, it is difficult to separate the contributions from each zone without some kind of zonal isolation. Moreover, the pumped nitrogen can itself affect the data being measured on the production logging tool, e.g., if there is a thief zone below the production logging tool, then it is conceivable the pumped nitrogen could go there instead of uphole to the surface.

For this reason, methods, apparatus, and systems of the invention may comprise zonal isolation tools including cup or non-inflatable packers for monobore operations, and inflatable packers for through-tubing operations. A pair of such packers may be positioned across a reservoir zone of interest and transmit fluid up the coiled tubing to an intermediate diverting section. As used herein "intermediate" means anywhere that is convenient between the base of the coiled tubing and the surface.

Figure 8:
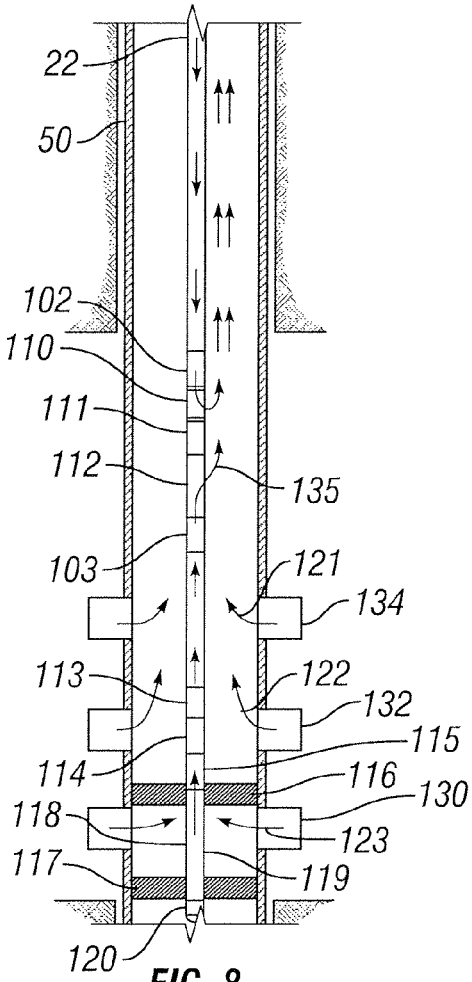
FIG. 8 illustrates schematically a spoolable testing system of the invention having a valve for diverting fluid, the valve positioned intermediate of the surface and the base of the coiled tubing, plus a downhole component with isolation and sensors, but that commingles fluid from a zone being tested with fluid from a zone above the zone being tested.

FIG. 8 provides zonal isolation. One primary advantage of this system is the ability to have the test zone flow into the annulus and have the produced fluids managed conventionally at surface. Illustrated in FIG. 8 is a monobore application wherein a coiled tubing 22 is inserted into casing 50. Coiled tubing 22 includes in the string a top part of a splittable, spoolable connection 102, a surface-controlled circulation valve or sub 110 (illustrated in circulation mode), a regular, unspoolable check valve 111, a dual ball valve 112, and a bottom part of a splittable, spoolable connection 104. Also illustrated are three production zones 130, 132, and 134, along with respective flows 123, 122, and 121. An optional disconnect 113 may be provided. Illustrated is a surface-controlled downhole shut-in valve 114, a reversible check valve 115 (which may be hydraulically, electronically, or fiber optically actuated), and a pair of conventional packers 116 and 117. A flow port 118 may be provided in between packers 116 and 117, as well as a gauge carrier 119 that may carry one or more sensors therein, and a bull nozzle 120 that may include an optional shear off.

Use of this method, apparatus and system includes use of a circulation port above the isolation packers. A test as we know it currently would be very difficult due to the communication with the upper zones. This system would depend on the test parameters, such as whether or not the influence of the upper zones would negatively impact the test or not.

The circulation port 135 would have to inserted above the isolation tools and need not require the development of a spoolable coiled tubing tube-to-tube connector because the entry to the annulus could be a relatively short distance above the bottom-hole assembly, but the interpretation of the testing results will be a lot simpler if the fluid exit to the annulus is far uphole, such as above all of the other reservoir zones.

Deployment of this system may require a positive isolation of the circulation port 135 during deployment. This can be accomplished through the use of a TIW style ball valve. This system could be used with real time or memory style production logging tools.

The embodiment of the invention illustrated in FIG. 8 provides the ability to perform a test evaluation on a zone of a reservoir that would allow for the influence of other zones on the test. The embodiment of FIG. 8 also allows selective circulation via a surface-controlled valve to allow fluids to circulate from within the coiled tubing to the coiled tubing annulus.

Figure 9:
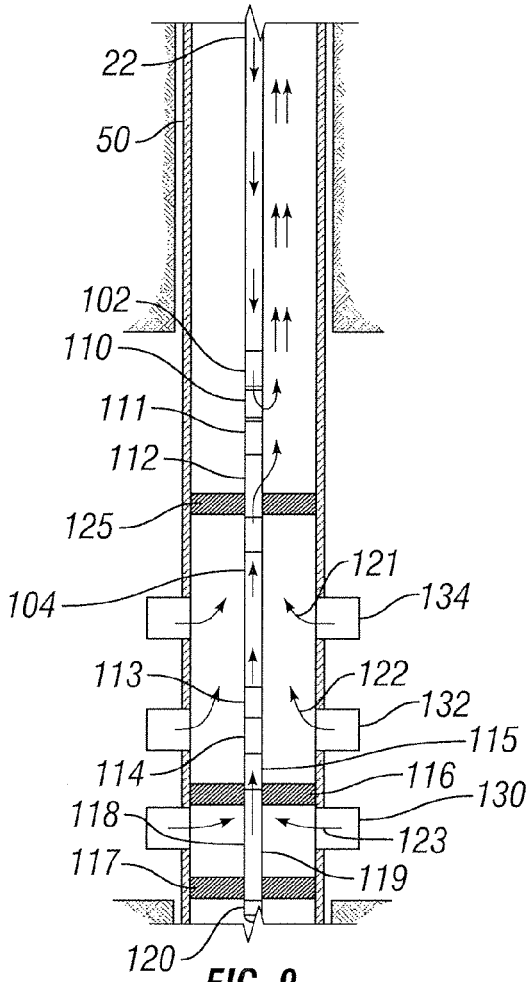
FIG. 9 illustrates schematically a spoolable testing apparatus of the invention having a valve for diverting fluid, the valve positioned intermediate of the surface and the base of the coiled tubing, plus a downhole component with valves and sensors for reservoir testing, illustrating an embodiment of an apparatus of the invention inside a monobore completion with and without gas lift that does not commingle fluid from a zone of interest with fluid from other zones.
Figure 10:
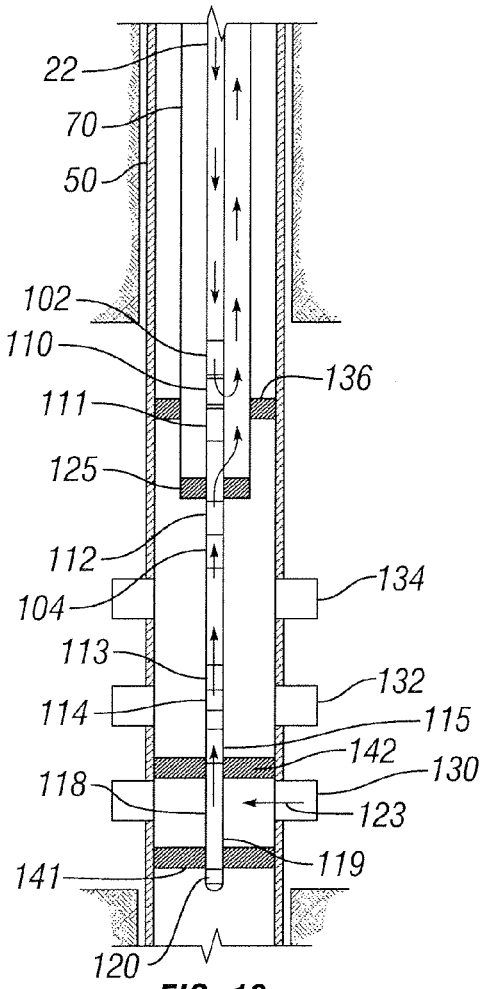
FIG. 10 illustrates schematically a spoolable testing apparatus of the invention having a valve for diverting fluid, the valve positioned intermediate of the surface and the base of the coiled tubing, plus a downhole component with valves and sensors for reservoir testing, illustrating a testing system through production tubing.

For many multilayered reservoirs, it will be necessary to bypass the upper zones and not have their flow contribution enter the surface measurements, as in the embodiment illustrated in FIG. 8. In such situations, the embodiments of FIGS. 9 and 10 may be useful. These embodiments would provide the necessary zonal isolation and bypass any upper zones to prevent any influence from those zones. The primary advantage of the embodiments of FIGS. 9 and 10 is the ability to have the test zone flow into the annulus at a point above the other contributing zones and still have the produced fluids managed conventionally at surface, eliminating the need to flow produced fluids through the coiled tubing at surface. FIG. 9 illustrates a monobore embodiment with and without gas lift that does not commingle fluid from a zone of interest with fluid from other zones;

FIG. 10 illustrates a through-tubing embodiment where producing zones 130, 132, and 134 are all below tubing 70 and gas lift may be provided from coiled tubing 22. In some applications of this embodiment, pumping nitrogen down the back-side of the production tubing could also provide the gas lift. In this embodiment, lower two packers 141 and 142 are coiled tubing inflatable packers, while third packer 125 may comprise a conventional tandem packer (mechanically actuated) with a cross flow tool. Optionally, third packer 125 may be an in-casing-set inflatable packer. All other components are as described previously.

The methods, apparatus and systems of the invention comprise a mid- or intermediate-string isolation apparatus. This apparatus may comprise "cup" style sealing elements. However, this would depend on the test parameters, and whether to inhibit the influence of the upper zones or to provide absolute isolation of a zone of interest.

An upper isolation system may be inserted mid- or intermediate-string to allow for lengths of up to 3000 ft (0.91 km) from the tested zone to the top of the shallowest influencing zone. A coiled tubing tube-to-tube connector system such as illustrated in FIG. 7 may be used for this purpose.

Deployment of a mid-string circulation system could be performed either by circulating the well to a kill weight fluid, or by installation of an internal isolation system during deployment of the coiled tubing into or out of the well. The latter method comprises management of the system to avoid coiled tubing collapse, buckling, and differential sticking of the system due to the third packer arrangement.

Methods, apparatus, and systems of this aspect of the invention comprise a reliable spoolable and splittable connector system and a selective circulation valve to allow fluids to circulate from within the coiled tubing to the coiled tubing annulus. The system functions to isolate the coiled tubing below the circulation valve for deployment and/or removal from the well. A cup-style non-inflatable packer system may be employed to isolate flow in the coiled tubing annulus below the circulation valve, and another valve to function in conjunction with the described system.

In other embodiments, methods, apparatus and systems of the invention may comprise replacing, when desired, the bottom-most two packers (in monobore applications) with hydraulic packers, so that these may be left in the well for a period of the pressure build-up test, and later either retrieved or moved to the next zone up to be tested.

Non-limiting examples are now provided for installing systems of the invention that does not commingle fluid from a zone of interest with fluid from other zones.

An example installation comprises a spliced coiled tubing, wherein the splice is positioned based on the highest difference between the bottom zone and the top zone in a field or area. Once at the wellsite, downhole tools may be installed at the end of the coiled tubing. The installed downhole tools include tools such as: coiled tubing connector; optional disconnect (hydraulicaly or electricaly operated, or operated by other means); surface controlled downhole shut-in valve; reversible check valve (hydraulicaly or electricaly operated, or operated by other means) (this valve could be integrated in the upper packer as well); upper packer (conventional tandem packer for monobore application, inflatable straddle for through tubing application); spacer pipes; one ported sub with optional burst disk for safety; gauge carrier, which may carry one or more downhole pressure and temperature sensors; lower packer (conventional packer for monobore application, inflatable straddle for through tubing application); and nozzle.

The coiled tubing will then be run in hole (RIH) until the splice section is below the stripper. At this point the coiled tubing injection is stopped, the BOP slip and pipe rams are closed on the coiled tubing pipe and tested, the pressure bled, and the injector head is separated from the coiled tubing BOP. There should be enough risers rigged-up between the injector head and the BOP that is sitting on top of the wellhead.

Once the riser is disconnected, the coiled tubing is lowered until the splice connection is exposed. The connection is undone, via the a threaded connection, turnbuckle connection, or other like connection built into the splice connector. Tools such as the following may then be connected between the top and bottom halves of the splittable spoolable connector (from top to bottom): surface controlled circulation sub; regular dual flapper check valve; cross-over tool (can also be built-into the top cross-over packer); top cross-over packer (conventional packer if in monobore application or if set inside the tubing string in the through tubing application. Inflatable packer if set in casing in the through tubing application scenario); and dual ball valve.

The riser connection to the BOP may then be made up, and the BOP slip and pipe rams opened. Then the coiled tubing may be RIH to target depth. Once at the target depth, there may be several processes taking place. All tools may be operated via hydraulics, electrical signals, fiber optic signals or otherwise. The general method is the same, although the specific operation will change slightly depending on the method of operation of the tools.

1) First, pressure up inside the coiled tubing to blow the burst disk in the ported sub.
2) All the packers are then set at the same time.
3) The reversible check valve is open, and the downhole shut-in valve should also be opened at this time.
4) The well is allowed to flow until the rate is constant.
5) The surface controlled shut-in valve is then closed, and the pressure build-up testing begins.

The surface-controlled downhole shut-in valve and the surface-controlled reversible check valve can both perform the same function, in a way that only one of them is needed for the operation. This is not necessary, though, so the method allows for two separate components to perform these functions independently. The pressure and temperature information is recorded in the downhole gauges.

Once the testing is finished, if need be, a remedial treatment can take place. For this to happen the shut-in valve has to be open and the downhole circulation sub has to be closed. The treatment fluid is then injected into the formation.

During the well test phase, there might be a need for pumping nitrogen, so the circulation valve may be opened and nitrogen pumped to lighten the hydrostatic and help the formation in testing to produce.

Once the first zone is tested, all packers can be unset at once, moved up, and reset and the process can be restarted for the other zones.

After all the testing in done, the surface controlled reversible check valve is closed, and the coiled tubing pulled out of hole until the split spoolable connector tags the stripper. At this point, the BOP slip and pipe rams are closed, the pressure bled, the riser disconnected.

All the tools are disconnected. At this point, the reversible check valve is holding the pressure from the well.

The split spoolable connector is made up together, the riser reconnected, the BOP rams are opened and the coiled tubing is pulled out of hole. The process is repeated until all the tools are out of the hole.

This process is safe due to the use of the reversible check valve, which again can be either hydraulically operated, electrically operated or fiber optic operated.

Figure 11:
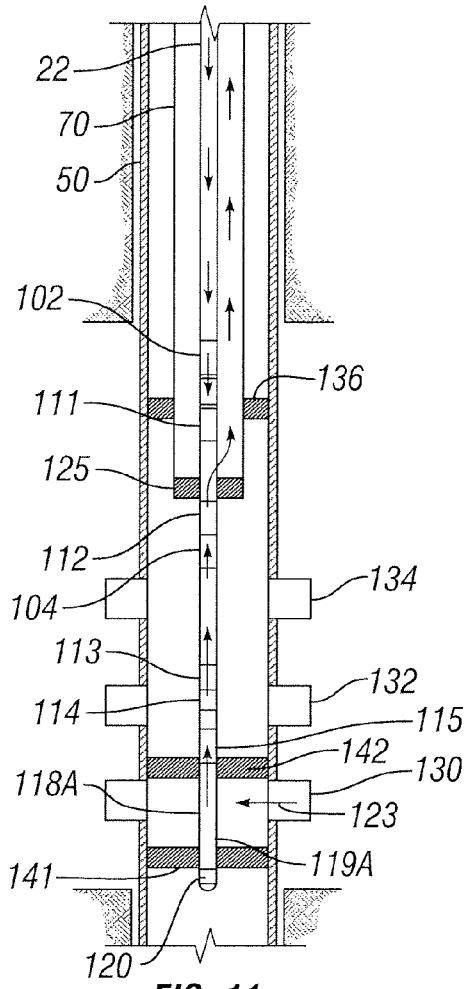
FIG. 11 illustrates schematically a zoned testing apparatus of the invention that removes the requirement for an intermediate diverter section; instead, a downhole sensor apparatus is included together with a communication system that can transmit downhole data in real-time during the testing.
Figure 12:
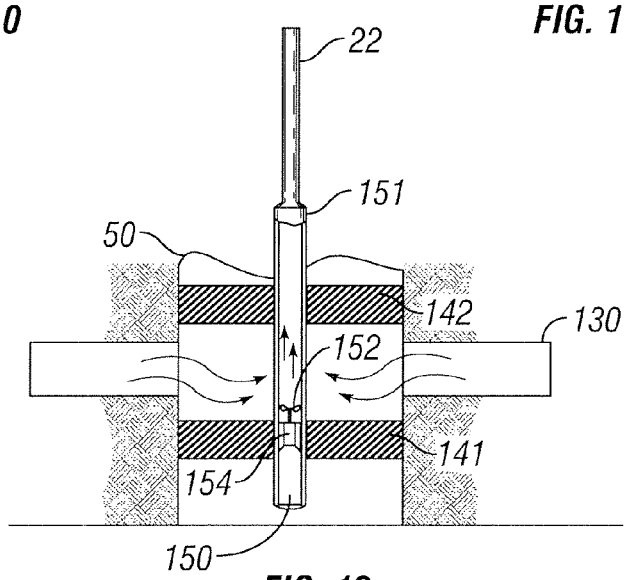
FIG. 12 illustrates schematically an apparatus of the invention able to transmit flow data to the surface; reservoir flow is diverted into an interior pathway within a bottomhole assembly, and a venturi or spinner is included and flow data transmitted to the surface.

FIG. 11 illustrates schematically a zoned testing apparatus of the invention that removes the requirement for an intermediate diverter section; instead, a downhole sensor apparatus is included together with a communication system that can transmit downhole data in real-time during the testing. Alternatively, one or more downhole sensors and communication components may be integrated into a bottom-hole assembly as illustrated in FIG. 12, discussed below. The systems as described have a key advantage in that they do not require any communications system within the coiled tubing. The reservoir testing information is performed in these embodiments with surface apparatus as in conventional well testing. The method relies upon the downhole valving apparatus (check valve 112) to ensure that only one zone is flowing at a time to that surface apparatus.

A reliable communication device has been described in reference to FIGS. 6A and 6B herein, which allows the use of the coiled tubing for both flow and reverse flow operations. The device may also be used to activate downhole controls and transmit downhole sensor data. This leads to another embodiment of the invention, wherein the use of the communication system allows elimination of spoolable connectors. Instead, the testing measurements and apparatus are conveyed downhole on the coiled tubing, using sensors similar to those of conventional wireline operations described herein in reference to FIG. 3. Transmitting downhole power is less of an issue for coiled tubing because hydraulic power is a much more efficient way of moving large amounts of power. This does not mean that hydraulic power needs to be used exclusively for downhole applications on coiled tubing. For example, an apparatus useful in the present invention utilizes a small battery to switch a hydraulic valve. The position of that valve has a large effect on the surface pressure while pumping, so the combination is almost like a transistor: a small amount of power moves the valve but the valve itself controls a large volume of fluid. Similarly, an apparatus useful in the present invention utilizes a battery to move a valve that controls whether or not surface pumped fluid is diverted into an inflatable packer (or a pair of such packers). When the packers are inflated the effect is that the coil to the surface is now in hydraulic communication with a zone of the reservoir and isolated hydraulically from the rest of the reservoir. Large volumes of fluid may then be pumped from the surface into that zone (e.g. to stimulate the rock with acid), or conversely the formation could be allowed to flow into the coil in order to clean out damage or precipitation in the near wellbore. Batteries useful in the invention may include primary cells, secondary (rechargeable) cells, and fuel cells. Some useful primary cell chemistries include lithium thionyl chloride [$LiSOCl_2$], lithium sulfur dioxide [$LiSO_2$], lithium manganese dioxide [$LiMnO_2$], magnesium manganese dioxide [$MgMnO_2$], lithium iron disulfide [$LiFeS_2$], zinc silver oxide [$ZnAg_2O$], zinc mercury oxide [ZnHgO], zinc-air, [Zn-air], alkaline manganese dioxide [alkaline-$MgO_2$], heavy-duty zinc carbon [Zn-carbon], and mercad, or cadmium silver oxide [CdAgO] batteries. Suitable rechargeable batteries include nickel-cadmium [Ni—Cd], nickel- metal hydride [Ni-MH], lithium ion batteries, and others.

FIG. 12 illustrates schematically an apparatus useful in the invention for transmitting flow data to the surface. Reservoir flow from formation 130 is diverted by packers 141 and 142 into an interior pathway within a bottomhole assembly (BHA) 150, which is connected to coiled tubing 22 via a connector 151. A venturi or spinner flow meter element 152 is included in the BHA 150, and flow data transmitted to the surface via a wireless transmitter 154, which could also operate via electric wire or fiber optic connection.

Figure 13:
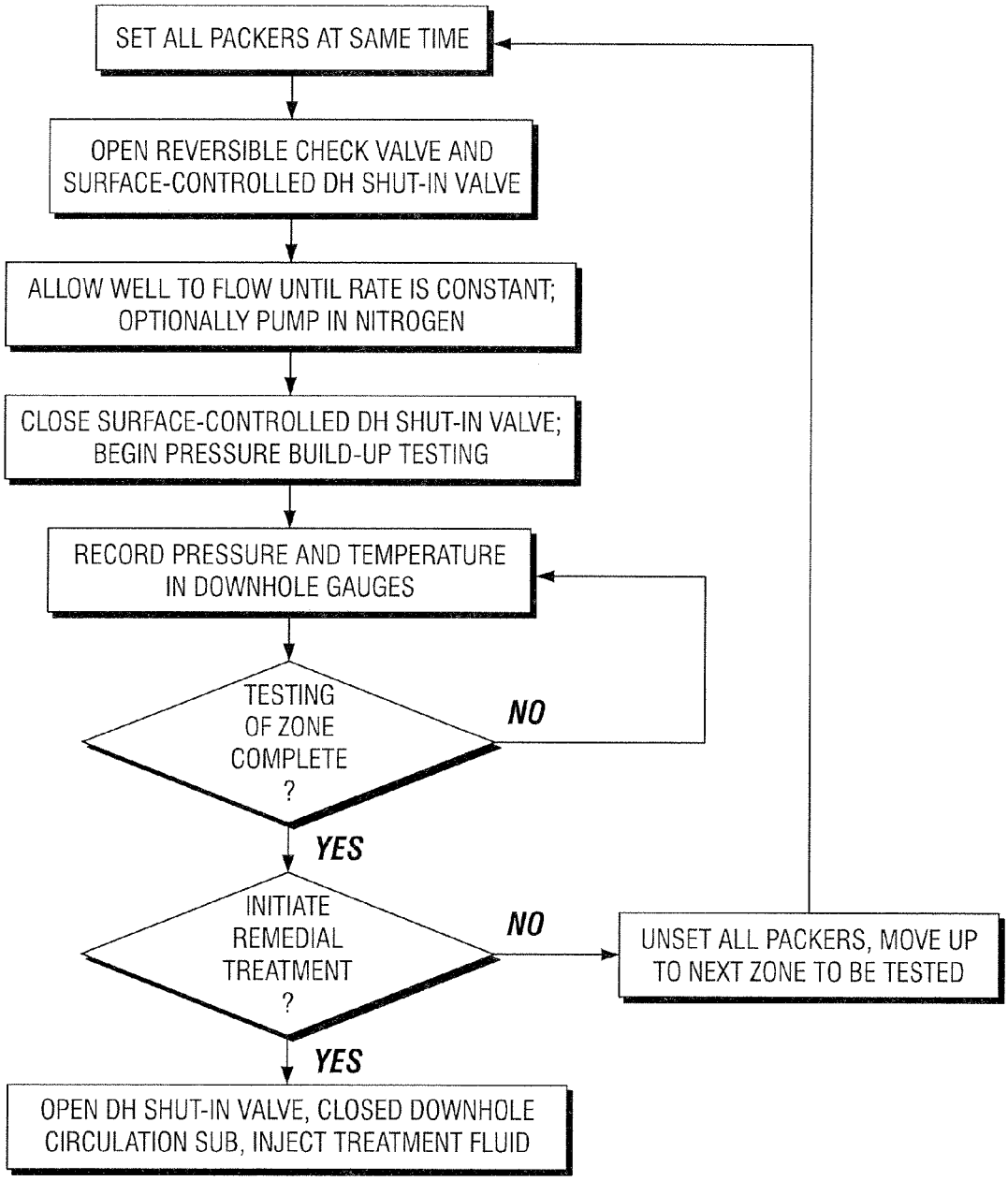
FIG. 13 is a schematic illustration of a method for testing of the invention including the steps of running spoolable tubing into the wellbore, providing zonal isolation and withdrawing formation fluid from the isolated zone of the reservoir.

FIG. 13 is a schematic logic diagram of a method of the invention for testing one or more producing zones of a wellbore, including the steps of pressuring up inside the coiled tubing to blow a burst disk in a ported sub; setting of all packers at the same time; opening a reversible check valve and a surface-controlled DH shut-in valve; allow a zone of the well to flow until flow rate is constant, and optionally pump in nitrogen for artificial lift; closing the surface-controlled DH shut-in valve; beginning pressure build-up testing; recording pressure and temperature in downhole gauges; determining whether remedial treatment is needed, and if not, repeating the steps for other producing zones.

In conclusion, methods, apparatus, and systems of the invention provide a downhole valving mechanism which uses a small amount of power downhole to divert fluids in a variety of ways, and wherein the operation of that valve is surface-controlled, either by a fiber-optic line to the surface, or other means, and wherein the fiber-optic line can also be used to pass communication about the status of the valve, and about parameters of the operation (typically pressure and temperature, but could be pH, flow-rate, and the like). The valve may be placed in position above a packer inflation enabling apparatus, with a fiber optic apparatus sending pressure, flowmeter and temperature data to the surface. The straddle packers of the apparatus are then inflated in the usual way, allowing hydraulic communication to and/or from the reservoir. Wellbore fluids are allowed to flow up out of the coiled tubing annulus. A pump may be used to speed this annular fluid flow. The check-valve about the packer inflation device may be activated to allow fluid to flow up from below the valve and into the annulus. This causes a draw-down in pressure across the straddle packer which would cause formation pressure to flow. The formation fluid potentially contains hydrocarbon so it would be risky to allow it to flow to the surface within the coiled tubing, but because of the valve mechanism, instead the hydrocarbon will go through the valve and out into the annulus. At the surface a BOP around the coiled-tubing diverts the annular flow safely into the production facilities, e.g., where it can run through testing equipment to analyze the properties of the hydrocarbon.

In this example, if there were no perforations in the casing above the straddle packer, then surface flow-meter data could be combined with the downhole pressure data to solve for reservoir properties such as skin, permeability and damage. If there are perforations above the straddle, this would not work, because the flow-meter would also be measuring the contribution of any fluids flowing in, or out, of those perforations. A downhole flow meter solves the problem, and its data may also be transferred to the surface via fiber-optic line, wireline, or wireless transmission. A spinner-type flow meter in the line of flow would lend itself well to a fiber-optic device because as the spinner turns it alternately blocks and releases a beam of light, which provide a data channel to a surface receiver. The faster the beam of light flickers on and off, the faster the spinner was turning, and the higher the measured flow rate.

Lastly, for wells with very low bottom hole pressure, sometimes even pumping out the annulus at the surface will not allow the wells to flow. In such cases, the valve mechanism could be set up to allow nitrogen or other gas, or mixtures of gases, to be pumped down the coiled tubing. The gas vents out to the annulus. Below, the reservoir fluid would no longer have to displace a hydrostatic column of fluid in the annulus and it would be "lifted" by the down-going gas. This is a natural extension of the embodiment of FIG. 9 to downhole testing.

For a somewhat more complicated valve apparatus, it is possible to combine the above valving system with the existing packer inflation system. Thus in one position fluid (or gas) from the surface is directed into the wellbore, in another position fluid is directed to inflate the packers, and in a third position there is direct hydraulic communication between the coiled tubing at the surface and the reservoir (e.g. to pump acid). When the valve is diverting surface fluid (gas) to the annulus it may also allow formation fluid via the packers to flow through the annulus. There may be a fourth position that allows flow to pass directly through the tool to any assembly underneath. Surface data to be transmitted may include temperature and pressure, possibly the pressure in each of the ports: coil, annulus, packer, reservoir and below the packer.

Similarly, if the well had a monobore construction, cup or non-inflatable packers may be used instead of inflatable packers. Or the packer elements could be inflated directly by pumping fluid down the coiled tubing. In both cases zonal isolation would only occur while the pumps were on, but a check-valve apparatus may be installed higher in the coiled tubing string to maintain pressure below it. This may be more successful for the inflatable packer approach because the coil underneath would be a closed system. Because of leakage into the formation, a continuous flow of fluid may be required to keep the cups isolated so non-inflatable (or hydraulic) packers may be employed.

Bringing the formation fluid into the straddle section raises the important possibility that the zone of the reservoir could be allowed to flow until it had reached steady state equilibrium. The reservoir fluid would pass through an inline flow measurement (spinner or venturi, for example) and this data may be monitored along with downhole pressure to ensure steady-state. At that point the inline flow may be stopped very quickly and the build-up of pressure data monitored. This is a significant improvement over pressure build-up tests done using drill-stem pipe.

Although only a few exemplary embodiments of this invention have been described in detail above, those skilled in the art may readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. §112, paragraph 6 unless "means for" is explicitly recited together with an associated function. "Means for" clauses are intended to cover the structures described herein as performing the recited function and not only structural equivalents, but also equivalent structures.

What is claimed is:

1. A method of testing a multi-zone reservoir while reservoir fluids are flowing from within a wellbore, comprising:

running a single string of coiled tubing into the wellbore with an annulus defined by an outer surface of the coiled tubing and the wellbore;

setting a first isolation apparatus to prevent reservoir fluid at a location downhole thereof from flowing to surface through the annulus;

activating a zonal isolation apparatus below the first isolation apparatus to isolate a first zone below the location;

allowing fluid to flow from the first zone through the coiled tubing;

measuring the downhole flow and pressure of the fluid flowing from the first zone; and diverting the fluid flow from the first zone to the annulus above the first isolation apparatus for recovery thereof.

2. The method of claim 1, further comprising the steps of deactivating the zonal isolation apparatus, moving the zonal isolation apparatus to a second zone, and activating the zonal isolation apparatus to isolate the second zone.

3. The method of claim 1, wherein the zonal isolation apparatus comprises a pair of inflatable packers.

4. The method of claim 1, further comprising the step of lowering the hydrostatic head in the annulus by pumping nitrogen into the annulus.

5. The method of claim 4, further comprising the step of transmitting the downhole measurements to the surface.

6. The method of claim 5, wherein the measurements are transmitted by optical fibers.

7. The method of claim 5, further comprising pumping a treating fluid based on downhole measurements.

8. An apparatus for testing reservoir fluids while they are flowing from a wellbore, the apparatus comprising:

a single string of coiled tubing defining an annulus between an outer surface of the coiled tubing and the wellbore;

a straddle system of packers activated to isolate a reservoir zone, the straddle system conveyed and positioned by the coiled tubing;

a surface controlled valve system that enables fluid pumped from the surface to flow into the wellbore annulus above the straddle system of packers, enables fluid pumped from the surface to flow into a zone isolated by the straddle system of packers, and enables fluid flowing from the isolated zone of the reservoir to flow into the annulus above the straddle system of packers; and a measurement apparatus positioned at the isolated zone to provide flow measurements for fluid flowing for recovery from the isolated zone, wherein the flow measurements are transmitted to surface equipment over an optical fiber running through said coiled tubing.

9. The apparatus of claim 8, wherein the packers of the straddle system of packers are inflatable packers.

10. The apparatus of claim 9, wherein the valve system further enables fluid pumped from the surface to flow into the straddle system of packers to activate the packers.

11. The apparatus of claim 8, further comprising a communication system for transmitting the flow measurements over the optical fiber to the surface.

12. The apparatus of claim 11, wherein the communication system comprises at least an upper communication system and a lower communication system positioned in the isolated zone.

13. The apparatus of claim 8, further comprising isolation means positioned above the straddle system of packers.

* * * * *